US006216517B1

(12) United States Patent
Hein

(10) Patent No.: US 6,216,517 B1
(45) Date of Patent: Apr. 17, 2001

(54) PRECISION-ROLLING PROCESS

(75) Inventor: Gerald Hein, Steyr (AT)

(73) Assignee: Voest Alpine Industieanlagenbau GmbH (AT)

( * ) Notice: Subject to any disclaimer, the term of this patent is extended or adjusted under 35 U.S.C. 154(b) by 0 days.

(21) Appl. No.: 09/554,561

(22) PCT Filed: Oct. 21, 1998

(86) PCT No.: PCT/AT98/00255

§ 371 Date: Jul. 13, 2000

§ 102(e) Date: Jul. 13, 2000

(87) PCT Pub. No.: WO99/25499

PCT Pub. Date: May 27, 1999

(30) Foreign Application Priority Data

Nov. 14, 1997 (AT) ..... 1932/97

(51) Int. Cl.[7] ..... B21B 39/00; B21B 13/08

(52) U.S. Cl. ..... 72/236; 72/226; 72/227; 72/250; 72/225

(58) Field of Search ..... 72/224, 225, 226, 72/227, 234, 365.2, 366.2, 250

(56) References Cited

U.S. PATENT DOCUMENTS

| | | | | |
|---|---|---|---|---|
| 3,513,697 | | 5/1970 | Thayer . | |
| 3,575,028 | | 4/1971 | Eibe . | |
| 3,824,830 | * | 7/1974 | Bennet et al. | 72/249 |
| 4,813,257 | * | 3/1989 | Feldmann et al. | 72/199 |
| 4,858,457 | * | 8/1989 | Potucek | 72/187 |
| 5,144,827 | * | 9/1992 | Lio | 72/224 |
| 5,363,682 | * | 11/1994 | Takeda et al. | 72/224 |

FOREIGN PATENT DOCUMENTS

| | | |
|---|---|---|
| 1527730 | 2/1970 | (DE) . |
| 2437545 | 2/1975 | (DE) . |
| 19625811 | 2/1997 | (DE) . |
| 0264849 | 4/1988 | (EP) . |
| 0549896 | 7/1993 | (EP) . |
| 0560115 | 9/1993 | (EP) . |
| 0720875 | 7/1996 | (EP) . |
| 0776709 | 6/1997 | (EP) . |
| 1213692 | 4/1960 | (FR) . |
| 1268213 | 3/1972 | (GB) . |
| 57-165101 | 10/1982 | (JP) . |

OTHER PUBLICATIONS

Yamanaka, et al., "Development of 4–Roll Size–Free Rolling Technology for Bar Mill", Cahiers D'Informations Techniques de la Revue de Metallurgie, vol. 93, No. 1, Mar. 1, 1996, pp. 427–438.

Kraemer, et al., "Hochpraezisionswalzen Von Stabstahl Auf der Feinstahl–und Drahtstrasse der Von Moos Stahl AG (Luzern/Schweiz)" Stahl und Eisen, vol. 110, No. 6, Jun. 14, 1990, pp. 59–64.

* cited by examiner

*Primary Examiner*—Rodney A. Butler
(74) *Attorney, Agent, or Firm*—Osterolenk, Faber, Gerb & Soffen, LLP

(57) ABSTRACT

A precision-rolling process for producing rolled stock in bar or wire form while maintaining tight shape and size tolerances is characterized, for the purpose of providing good accessibility to the roll stands, by the combination of the following features: rolling of the stock in at least one two-high roll stand with an open pass, starting from any desired cross section, to form rolled stock which is polygonal, in particular tetragonal, in cross section, guiding the rolled stock over a predetermined distance along one or more longitudinal edges and/or along those surfaces of the rolled stock which adjoin longitudinal edges, to a further roll stand, and subsequent rolling to form rolled stock which is circular in cross section in at least one closed pass, in which rolling forces act on and deform the rolling stock in a star shape from at least three directions.

14 Claims, 5 Drawing Sheets

FIG. 6a
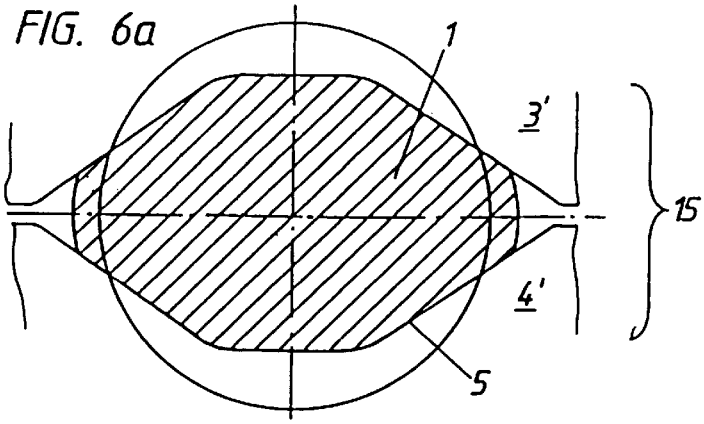
FIG. 6b
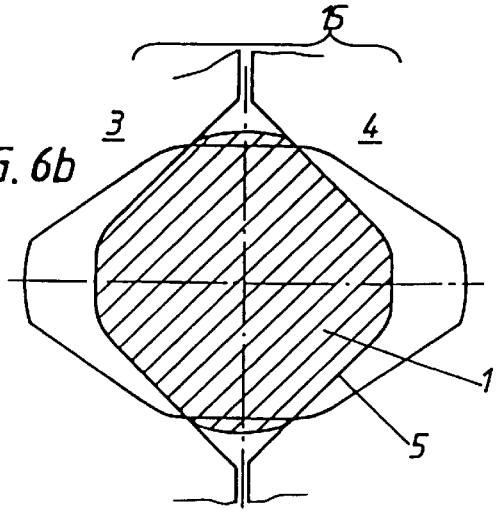
FIG. 6c
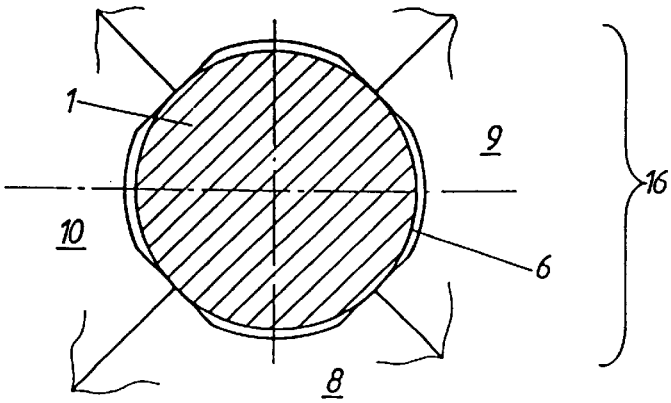
FIG. 5a
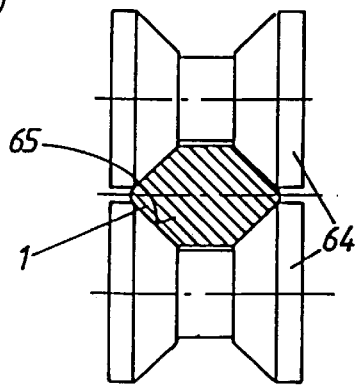
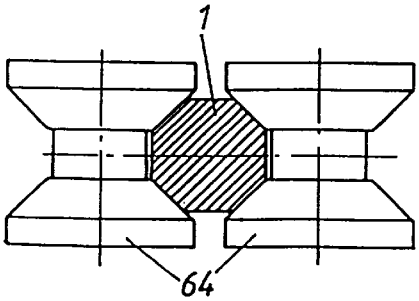
FIG. 5b

PRECISION-ROLLING PROCESS

The invention relates to a precision-rolling process for producing rolled stock in bar or wire form which is circular in cross section, while maintaining tight shape and size tolerances, and to a profile-rolling device for carrying out the process.

Currently, a plurality of systems for the precision-rolling (sizing) of rolling stock in bar form are known. The known systems are employed after continuous bar steel rolling mill trains or before or after wire blocks for the purpose of improving the dimensional accuracy of the rolling stock.

A known system comprises three two-high roll stands, in the order horizontal-vertical-horizontal. In this system, the round emerging from the continuous rolling mill train is deformed with the pass sequence oval-oval-round, with a low degree of deformation, to the desired final dimensions.

The drawbacks of this system are as follows: the oval cross sections are difficult to guide using the known rolling-stock guides. The rolling stock tends to become tilted, i.e. to twist in cross section, in particular if the distance between the stands is too great. Therefore, the rolling stock is not guided between the stands and the distance between the stands is selected to be as short as possible. This results in the further drawback that, in the event of disruption to the passage of rolling stock, the rolling stock which has become jammed can only be removed with difficulty. Maintenance of the stands is also complicated and laborious. A third drawback is the very complicated dimensional setting of the roll passes to the final dimensions, owing to the need to take into account the bearing clearances and the thermal expansion of the stands during operation.

A further system comprises two two-high stands, in the sequence vertical-horizontal, the second stand having preloaded rolls. In this case too, the round emerging from the continuous rolling mill train is deformed, with the pass sequence oval-round, to the desired final size. The preloaded rolls of the finishing stand compensate for the bearing clearances and the thermal expansion of the stand. In this case too, the major drawback of the difficulty of guiding the oval cross section into the round pass remains.

A third system comprises a rolling block with three rolling stands, in each of which three rolls are arranged at 120° to one another. The round emerging from the continuous rolling mill train is deformed, with the pass sequence trigonal-trigonal-round, to the desired final size. The drawbacks in this case are, firstly, the high mechanical outlay for driving and synchronizing the three rolls per stand, and, secondly, the fact that there is no compensation for the bearing clearances and thermal expansion of the stands.

The fourth known system comprises two roll frames, each with four rolls, of which in each case only a pair of rolls is driven, while the other pair is moved by the rolling stock. The roll axles of the second roll stand are arranged rotated through 45° with respect to the first. This system too has the drawback of the difficulty of presetting the roll passes, since the bearing clearances and thermal expansion have to be taken into account. Further drawbacks result from the position of the drive of the second stand, which is rotated through 45°, requiring a complicated mechanical drive. A further drawback is that the undriven pairs of rolls have to be accelerated to their working speed by the entry of the start of the rolling stock, which may result in damage to the base of the pass.

The invention aims to avoid these drawbacks and difficulties and is based on the object of providing a precision-rolling process for producing rolling stock in bar form or wire with a circular cross section, resulting in rolled stock with a particularly high level of accuracy and in a specific size while nevertheless—unlike in the prior art—providing ease of access to each of the roll stands, so that rolling can be continued again within a short period even in the event of disruption, i.e. so that the operating readiness of the installation can be restored as quickly as possible and simple maintenance is possible.

In a process of the type described in the introduction, this object is achieved by means of the combination of the following features:

- rolling of the rolling stock in at least one two-high roll stand with an open pass, starting from any desired cross section, to form rolled stock which is polygonal, in particular tetragonal, in cross section,
- guiding the rolled stock over a predetermined distance along one or more longitudinal edges and/or along those surfaces of the rolled stock which adjoin longitudinal edges, to a further roll stand, and
- subsequent rolling to form rolled stock which is circular in cross section in at least one closed pass, in which rolling forces act on and deform the rolling stock in a star shape from at least three directions.

As a result of the bar steel being guided in order to be introduced into the further roll stand, which guidance is made possible by the polygonal cross section of the bar steel emerging from the two-high roll stand, it is possible to ensure that the feed of the bar steel into the further roll stand remains precisely constant along the entire length of the bar steel, so that both uniform deformation of the bar steel and, as a result, a uniform cross section can be achieved, and, owing to the uniform deformation, there is no tilting or the like even after the bar steel has emerged from the roll stand.

Preferably, the rolling stock is rolled in two two-high roll stands, which are arranged one behind the other, to form rolled stock which is tetragonal in cross section, and is guided between these two two-high roll stands.

A profile-rolling device for carrying out the process according to the invention is characterized by:

- at least one two-high roll stand with an open, polygonal, in particular tetragonal, roll pass,
- a rolled-stock guide which adjoins the two-high roll stand in the rolling direction and has guide devices which guide the rolled stock emerging from the two-high roll stand on one or more longitudinal edges and/or on the surfaces of the rolled stock which adjoin longitudinal edges of the rolled stock, and
- at least one further roll stand with a closed, circular pass with at least three rolls arranged in a star shape.

A roll stand with a closed pass is known, for example, from DE-A-1,527,722. It has four discs, the working surfaces of which form a closed pass. Two opposite disc rolls are driven, whereas the other two disc rolls are moved by means of the material which is to be rolled. The disc rolls may be adjusted with respect to one another, so that the size of the pass can be varied. Each disc roll is acted on by another disc roll, displacement of the disc rolls in the radial direction of the other disc rolls enabling this change in the pass to take place. However, this means that the disc rolls can only be held together by relatively low forces, since it is impossible to apply any oppositely directed forces in order to prevent the disc rolls from becoming bent. Even without the additional action of forces which is brought about by the rolling, a closed pass of this nature is rather unsuitable for the long-term formation of a closed pass, and in fact there tends to be an undesirable change in size of the pass, so that the desired dimensioning of rolled stock cannot be achieved.

A particularly advantageous embodiment according to the invention is characterized in that two two-high roll stands with a tetragonal roll pass are provided with a guide arranged between them.

According to the invention, to make it easy to produce a pass which is always closed even under heavy rolling conditions, according to a preferred embodiment the rolls of the further roll stand are supported against one another by way of conical surfaces, the rolls being pressed against one another by a screw-down force which exceeds the rolling force by a preloading force.

A roll stand with a closed pass of the type described above is known per se, for example from EP-A-0,264,849.

According to the invention, the closed pass preferably has a cross-sectional area which is 5 to 20% smaller than that of the open pass of the two-high roll stand. This makes it possible to roll even steel alloys with a high resistance to deformation with particular accuracy, and the low rolling forces which result mean that it is even possible to achieve high rolling speeds.

A preferred embodiment is characterized in that the further roll stand has four rolls, in particular disc rolls, of which only two opposite rolls can be driven by means of a motor, in particular by a common motor, and in that each of the four rolls bears against a conical surface of a further roll by way of in each case a conical surface, each roll bearing against two adjoining rolls, and a closed flux of force and a frictional drive for the rolls which are not driven by a motor being established via the conical contact surfaces of the rolls.

This provides a particularly advantageous forced closure within the pass, and as a result of the drive being divided up into, on the one hand, a forced drive via a motor and, on the other hand, via the conical surfaces, it is possible to synchronize the rolls by extremely simple means. The disc rolls ensure that the loads on the shaping surfaces of the rolls can be kept at a lower level owing to the greater circumference.

Advantageously, the driven rolls of the further roll stand have a larger diameter in the shaping surfaces than the rolls which are not driven by means of their own drive, with the result that the steel bars can be introduced into the further roll stand particularly easily, so that the desired cross section is obtained particularly quickly in particular even in the end region of the steel bar.

According to another preferred embodiment, those rolls of the further roll stand which can be driven by means of a motor can be displaced towards the two further rolls in the direction of their shafts, with the result that the further roll stand is positioned accurately both with regard to the first roll stand and with regard to the guide, so that the axis of the rolling stock can be kept completely straight in the rolling mill train.

Advantageously, the further roll stand has two stand units which are preloaded towards one another by means of tie bars and threaded nuts. As a result, it is possible to apply particularly high forces, so that a reduction in the cross-sectional area of the rolling stock can be achieved with a particularly high level of accuracy and, at the same time, high speeds can be achieved. The design with tie bars and threaded nuts makes it possible to produce a particularly simple design of the stand units which, at the same time, is particularly reliable.

If the threaded nuts are hydraulic nuts, they are particularly simple to fit, specifically without having to use an additional tool.

If the two-high roll stand and/or the further roll stand is/are in each case arranged on a stand-changing trolley which can slide along rails into a working position and can be fixed in that position and, from this position, can slide back into an at-rest position, it is possible for the rolls to be changed particularly easily while, at the same time, enabling the roll frame to be positioned with accuracy in a particularly simple manner.

Expediently, the shaping surfaces of the rolls which form the closed pass have a chamfer on the circular edges which adjoin one another. In this way it is possible to ensure that, even in the event of irregularities in the cross-sectional area of the rolling stock coming out of the two-high roll stand or in the event of the speeds not being matched between the two-high roll stand and the further roll stand, the cross-sectional area of the rolled stock is accurate, while the load on the shaping surfaces of the further stand is kept particularly low.

A particularly simple configuration of the guide devices is characterized by shaping rollers. These rollers are expediently arranged in pairs so as to form a pass which is adapted to the cross-sectional shape of the rolling stock which is to be guided. Furthermore, an appropriate number of shaping rollers, which depends on the distance, is provided in order to form a roller conveyor.

The invention is explained in more detail below with reference to two exemplary embodiments which are illustrated in the drawing, in which FIGS. 1*a* to 1*d* illustrate a sequence of passes for the rolling process according to the invention and the device for carrying out the process.

FIG. 2 diagrammatically depicts two roll stands, which are arranged one behind the other, of the profile-rolling device according to the invention.

FIGS. 6*a* to 6*c* show the sequence of passes according to a further embodiment.

Figure 1C:
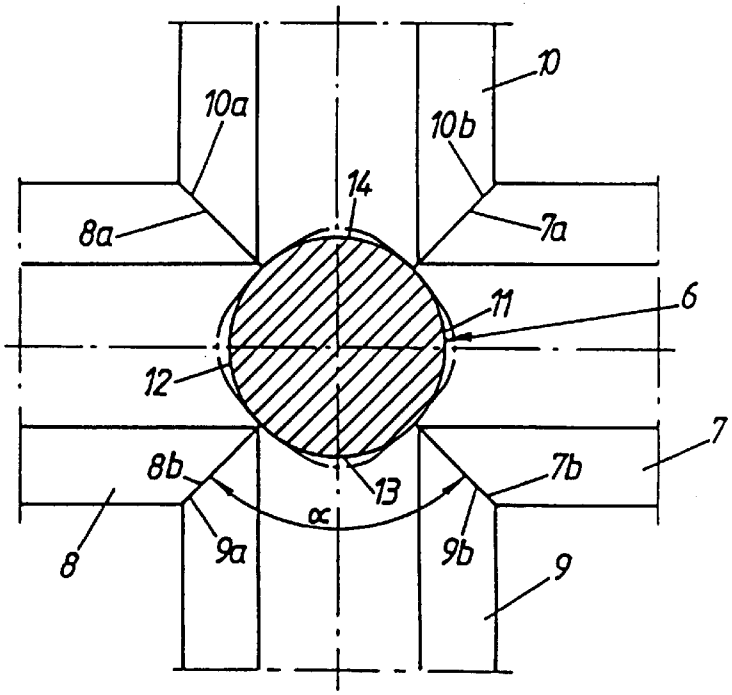
Figure 1B:
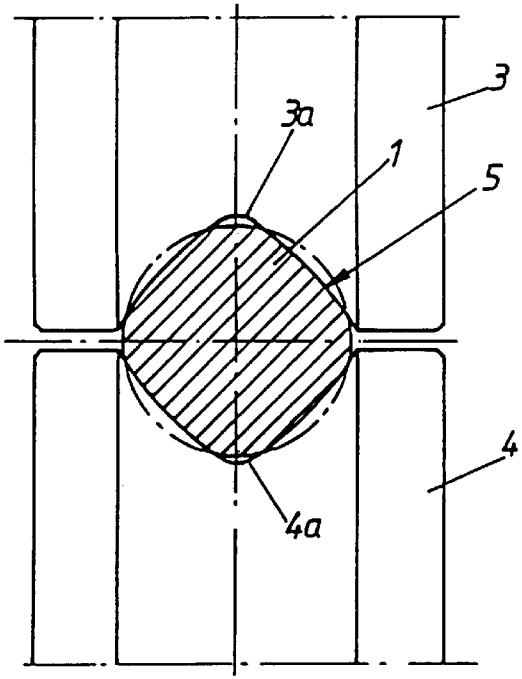
Figure 1D:
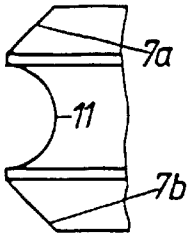
Figure 1A:
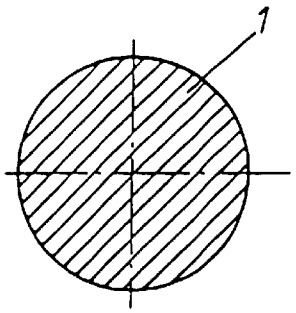

The rolling stock 1 which is to be deformed, a bar steel, is deformed, starting from the round cross section shown in FIG. 1*a* (and illustrated by dot-dashed lines in FIG. 1*b*), to form a substantially tetragonal cross section by means of the rolls 3, 4 illustrated in FIG. 1*b*, with grooves 3*a*, 4*a*, of a two-high roll stand with open pass 5 so as to reduce the cross-sectional area. This now tetragonal bar steel, which may also have a different polygonal cross section, such as for example a triangular, pentagonal or similar cross section, passes into the closed pass 6 which is illustrated in FIG. 1*c* and has four disc rolls 7, 8 and 9, 10, in which it is rolled back into bar steel with a round cross section, but of high precision.

At the areas which adjoin the pass partial faces 11, 12 and 13, 14, the disc rolls 7 to 10 have conical surfaces, specifically 7*a*, 7*b*, 8*a*, 8*b*, 9*a*, 9*b* and 10*a*, 10*b*. These surfaces each include an angle α of 90°, so that the individual disc rolls 7 to 10 can be pressed against one another, given frustoconical faces of the same sizes, with minimum slip, with the result that, on the one hand, a closed pass is formed and, on the other hand, the drive from one pair of disc rolls can be carried over to the other pair of disc rolls with high forces acting. As shown in FIG. 1*d*, the edges between the frustoconical faces 7*a*, 7*b* and the pass partial face 11 may be chamfered, resulting in a pass which, although still closed, allows surface pressure peaks to be avoided.

The closed pass, which is illustrated in FIG. 1*c*, may also be of any other shape, for example tetragonal or some other polygonal cross section, oval or the like.

With regard to the sequence of passes 5 and 6, with a view to obtaining uniform deformation it is necessary to ensure that the successive rolling passes do not always carry out deformation in the same or similar directions, but rather that the deformation takes place, for example, perpendicular to the first direction of deformation, so that, with regard to the overall cross section, the deformations are substantially uniform.

Figure 2:
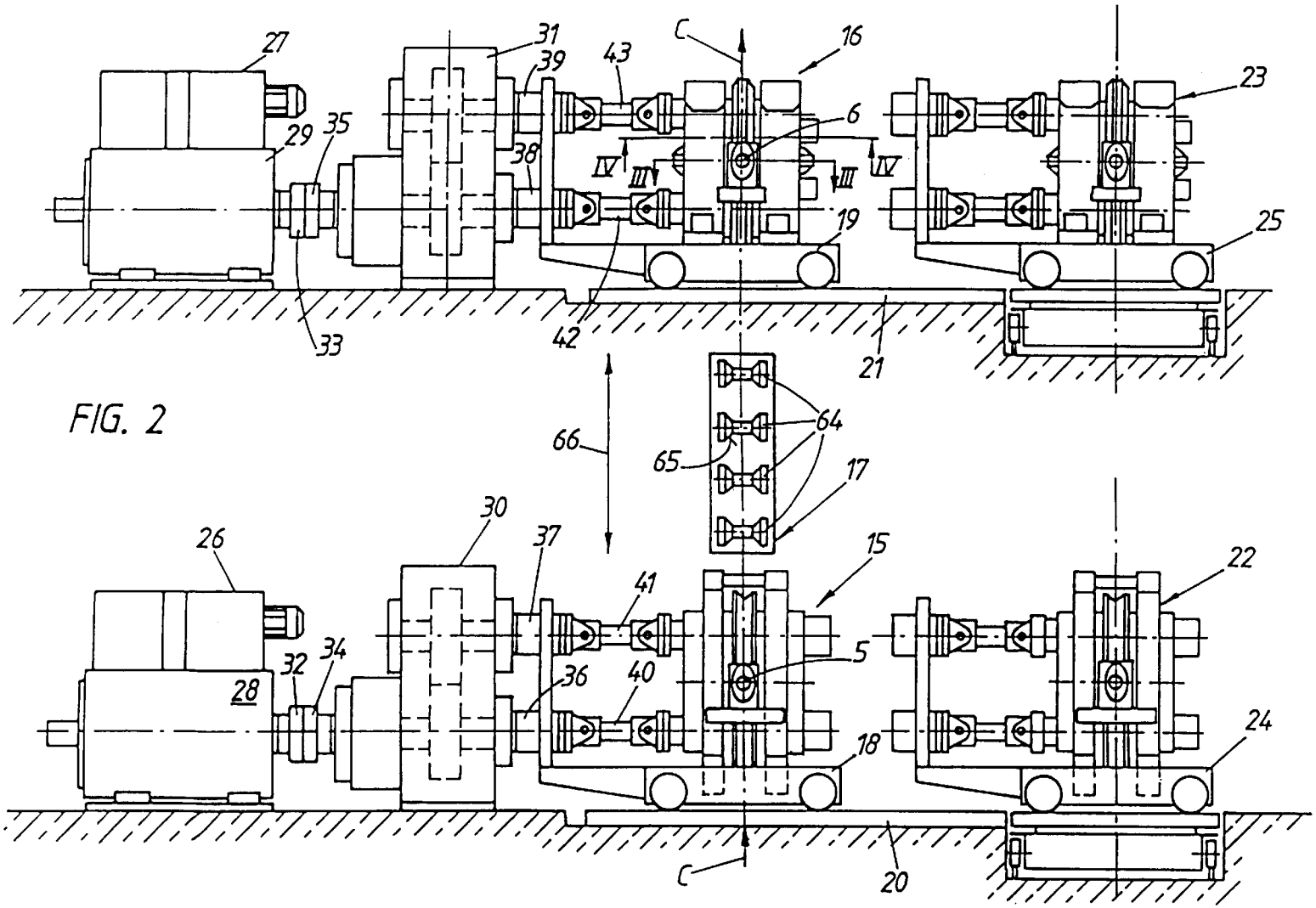

FIG. 2 shows two roll stands 15, 16 arranged one behind the other in the direction of rolling c, specifically a two-high roll stand 15 with the open pass 5 and a four-disc roll stand 16 with the closed pass 6. To make the drawings clearer, both the two-high roll stand 15 and the four-disc roll stand 16 are shown in a front view. A rolling-stock guide 17, a detail of which can be seen in FIG. 5*a*, is diagrammatically illustrated between the roll stands. The roll stands 15 and 16 are each arranged on a stand-changing trolley 18 and 19, which can be moved out of the working position along rails 20 and 21, while the roll stands 22 and 23, which are in the at-rest position and are likewise arranged on stand-changing trolleys 24 and 25, can be displaced into the working position. All that is required is for rails which are likewise parallel to the direction of rolling c to be provided, so that at the intersection of the rails running at right angles to and parallel to the direction of rolling c the trolleys 18, 19 can be turned and thus moved out of the rolling position, and the further roll stand can then be moved into the working position again. A procedure of this nature is required if either the cross section of the bar steel 1 is to be changed or the rolls 3, 4 and 7 to 10 have become worn and need to be exchanged.

Both roll stands 15, 16 have electric motors 26, 27, the rotational speed of which can be accurately regulated, and the reduction to a lower number of rotations is achieved by means of transmissions 28, 29, while the rotational movement is transmitted from one shaft to two shafts of the two-high roll stand 15 or a pair of rolls of the four-disc roll stand 16 substantially in adjoining transmissions 30 and 31.

The way in which the drive is controlled must take into account the reduction in cross section, in such a manner that it is not a uniform speed of the rolling stock 1, but rather a uniform mass throughput rate in the roll stands 15, 16 which is achieved, in order to avoid any disruptions in the rolling operation. However, it may also be advantageous for the four-disc roll stand 16 to be at a slightly greater rolling speed than would be necessary for the mass throughput from the two-high roll stand 15, with the result that a lower tension is exerted on the rolling stock between the two-high roll stand 15 and the four-disc roll stand 16 so that, as is known, problems can be avoided more easily. The transmission of forces between the transmissions 28 and 30 and 29 and 31 is brought about by means of shafts 32 and 34 and 33 and 35, which are flanged together by means of flanges and an intervening Hardy disc (not shown). The force is output from the transmissions 30 and 31 via shafts 36, 37 and 38, 39 and, via universal joints 40, 41, 42 and 43 is introduced directly into the shafts of the roll stands 15 and 16.

Figure 3:
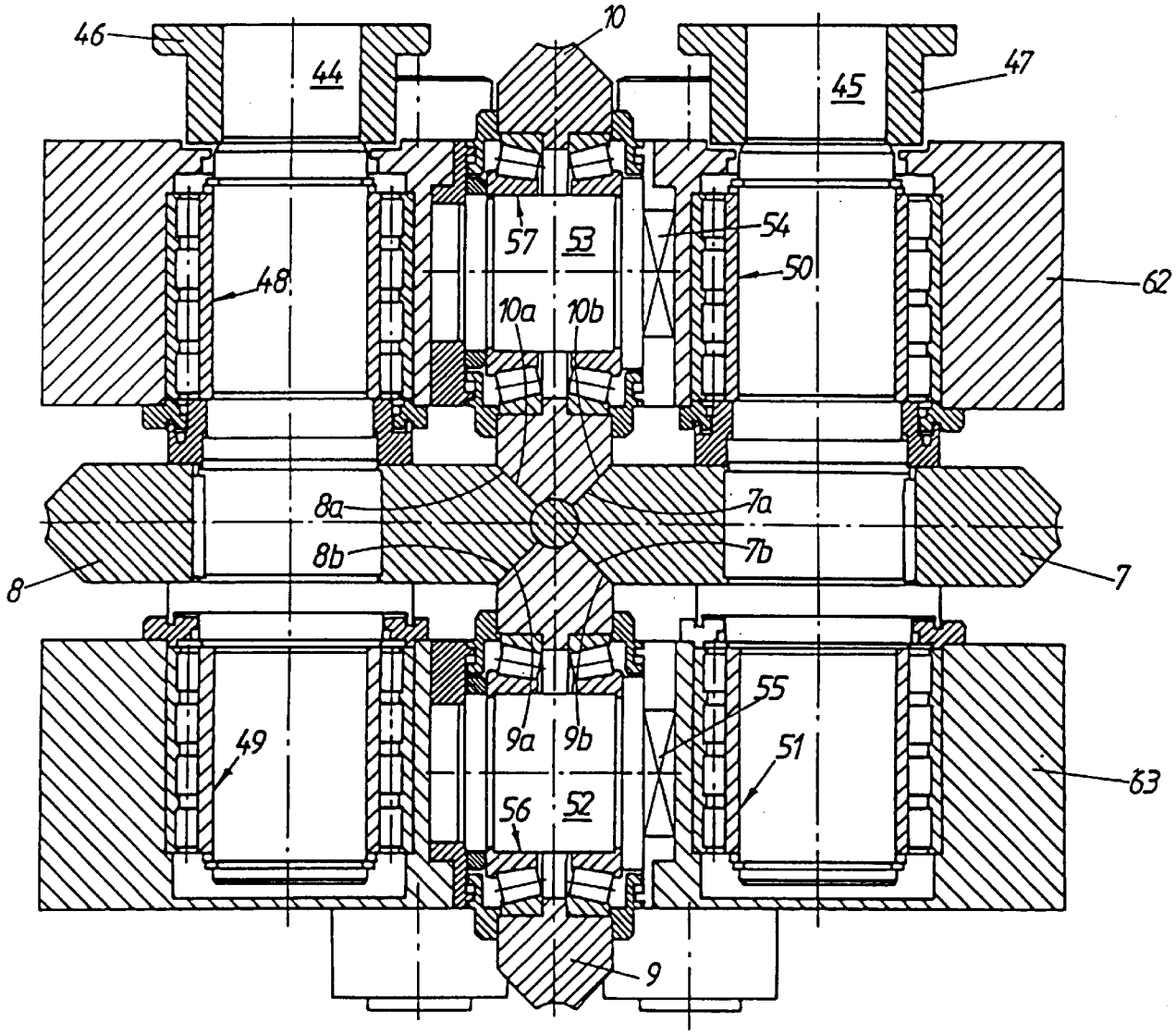
FIG. 3 illustrates a section through the roll stand on line III—III from FIG. 2.

FIG. 3 diagrammatically depicts the four-disc roll stand 16 in section, the force being introduced into the shafts 44 and 45 via flanges 46 and 47. The shafts are mounted in rolling bearings 48, 49 and 50, 51 of stand units 62, 63, in which the further disc rolls 9 and 10 are likewise mounted in this way.

The disc rolls 9 and 10 are not driven, but rather are arranged in a transversely displaceable manner on axles 52 and 53, which transverse displacement can be carried out by means of spacer discs 54 and 55, enabling the position of the disc rolls 9 and 10 to be fixed. The disc rolls 9, 10 are likewise mounted by means of rolling bearings 56, 57.

Figure 4:
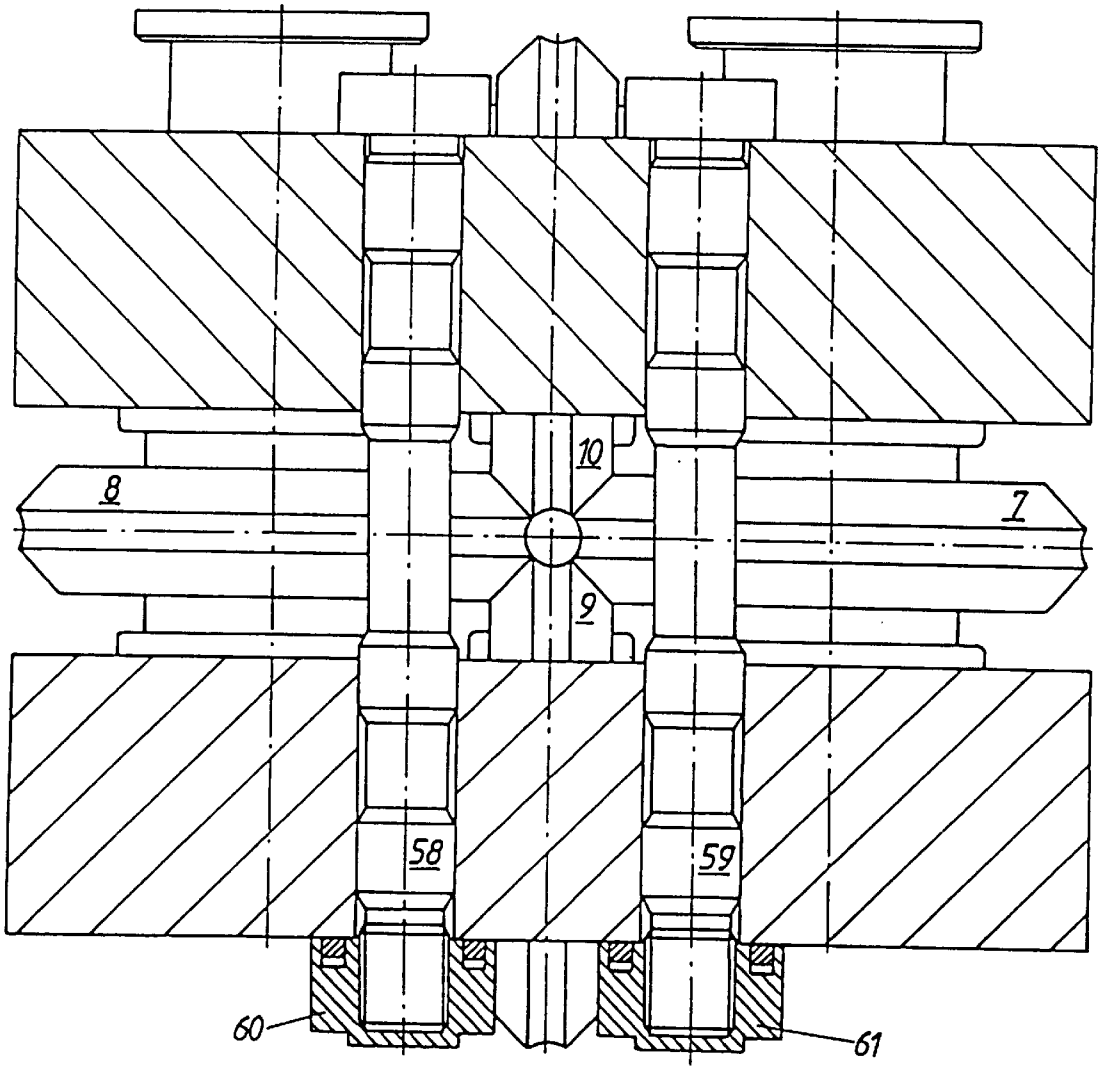
FIG. 4 shows a section through the roll stand on line IV—IV from FIG. 2, and FIGS. 5*a* and 5*b* each illustrate an exemplary embodiment of a guide device between the roll stands.

The disc rolls 7, 8, 9, 10 are held in contact with one another by way of their conical surfaces 7*a*, 7*b*, 8*a*, 8*b*, 9*a*, 9*b*, 10*a* and 10*b*, the relative position of the disc rolls 7 and 8 with respect to one another being provided by the rigid arrangement in the flexurally unyielding roll stand, whereas the disc rolls 9 and 10, as can be seen particularly clearly from FIG. 4, are held together by means of tie bars 58, 59 and hydraulic nuts 60 and 61. In each case four tie bars 58, 59 are provided, specifically two in front of and two behind that area in which the closed pass 6 through the four disc rolls 7 to 10 is present, so that they are clamped together symmetrically at the actual area of deformation.

The rolling-stock guide 17 which is illustrated in FIG. 5*a* and is used for rolling stock 1 is vertically and laterally adjustable on one side by means of suitable pinions (not shown) and has a guide track for the rolling stock 1, which track is oriented in the direction of rolling and is produced by shaping rollers 64 which are arranged behind one another, and in each case in pairs, enclosing a pass 65 corresponding to the cross section of the rolling stock 1 which is to be guided. The guide device could also be formed by guide faces, so that the bar steel 1 emerging from the two-high rolling mill 15 can be guided precisely and the bar steel 1 is introduced into the four-disc rolling mill 16 in an accurately reproducible manner. FIG. 5*a* illustrates an embodiment of shaping rollers for an octagonal cross section of the rolling stock 1.

The arrangement according to the invention of a rolling-stock guide 17 makes it possible to move the two roll stands 15 and 16 further apart without the precision of rolling executed by the roll stand 16 suffering. By way of example, it is possible, according to the invention, to achieve a distance 66 between the roll stands 15 and 16 of from 1.5 to 2 m, whereas without such guidance the roll stands 15 and 16 would have to be arranged very close together, for example within half a meter or less. Therefore, according to the invention the second roll stand 16 is also readily accessible, so that operation and maintenance are very considerably simplified. Moreover, any material jams between the two roll stands can be removed without difficulty.

Despite the relatively great distance 66 between the two roll stands 15 and 16, even the start and end regions of the rolling stock 1 can be rolled with particular accuracy to the desired dimensions. It is essential that the rolling stock 1 be polygonal in cross section between the two roll stands 15 and 16, since only in this way is it possible for the rolling stock 1 to be guided accurately between these two roll stands 15 and 16. If the rolling stock 1 were to be round, for example circular, in cross section in this area, it would be impossible for the rolling stock to be guided accurately. Tilting of the rolling stock would have adverse effects, and not only on the way in which the rolling stock is guided, for example when it is introduced into the further roll stand 16.

FIGS. 6*a,* 6*b* and 6*c* show the sequence of passes according to a further embodiment of the invention; in a first two-high roll stand 15' (FIG. 6*a*) with grooved rolls 3', 4', rolling stock 1 which is slightly oval in cross section (unhatched area) is rolled into rolled stock which is substantially tetragonal in cross section (hatched area in FIG. 6*a*). This first two-high roll stand 15' is arranged horizontally. In a subsequent vertical two-high roll stand 15 (FIG. 6*b*) having the grooved rollers 3, 4, the cross section is reduced to form rolled stock 1 which is likewise tetragonal in cross section (hatched area in FIG. 6*b*), the rolled stock 1 being guided between the first two-high roll stand 3', 4' and the following two-high roll stand 3, 4 again by means of a rolling-stock guide 17, preferably a guide track with guide rollers 64.

Following the second two-high roll stand 15, the rolled stock is rolled in a four-disc roll stand 16 (FIG. 6*c*) having the grooved rolls 7, 8, 9, 10, to form rolled stock with a circular cross section of extremely high precision. A rolled-stock guide 17, preferably likewise formed by guide rollers 64, is provided between the second two-high roll stand 15 and the four-disc roll stand 16.

EXAMPLE

Continuous-cast billets made from carbon steel, e.g. C10, with a square cross section with side lengths of 150 mm are rolled in a roughing pass train to a round cross section with a diameter of 22 mm. Then, the steel bars formed in this way are fed to a first two-high roll stand 15'. In this two-high roll stand 15', the cross section is reduced by 28%. This is followed by further rolling in a second two-high roll stand 15 with a pass reduction of 22%, to form a tetragonal cross section. The steel bar 1 emerging from the second two-high roll stand 15 passes, via the guide 17, into the four-disc roll stand 16, in which a circular cross section is produced, and consequently the cross section is reduced further by 19%. The rolls 3 and 4 of the two-high roll stand 15 and the four-disc roll stand 16 have a diameter of 320 cm. The speed of the steel bar 1 emerging from the four-disc roll stand 16 is 15 m/sec.

In the four-disc roll stand 16, a force of 20 tonnes is exerted via the tie bars 58, 59 and hydraulic nuts 60, 61.

Pairs of guide rollers 64 are used to guide the steel bars 1 between the roll stands 15 and 16 which are arranged approximately 2.5 m apart.

The process according to the invention can be used to produce finished products which are circular in cross section and have a very high level of precision, both in terms of size and shape, for example finished products in the diameter range of up to 25 mm with a guaranteed minimum tolerance of ±0.1 mm, and in the diameter range from 25 to 100 mm with a minimum tolerance of ±0.25% of the diameter.

In addition, the process according to the invention and the device according to the invention simplify rolling operation, to the extent that for different diameters of the finished product, the roughing train arranged upstream of the profile-rolling device according to the invention does not require any change in pass; it is only necessary to change the pass for the profile-rolling device according to the invention, resulting from the possibility of substantial variation in the pass reduction in the diameter range of at least 1:4 which results from the profile-rolling device according to the invention. It is thus possible, starting from the same rolling stock fed to the profile-rolling device according to the invention, to produce a finished product of, for example, 25 to 100 mm.

Furthermore, according to the invention it is possible to produce a finished product of any desired diameter, i.e. the diameter of the end product can be selected from a continuous scale; there is no need for step changes in diameter.

Since the roll stand 16 with closed pass 6 and preloaded rolls 7 to 10 can be machined in the closed, preloaded state, the production of a specific pass is particularly simple.

What is claimed is:

1. Precision-rolling process for producing rolled stock in bar or wire form which is circular in cross section, maintaining tight shape and size tolerances, comprising a combination of the following features:

rolling of the rolling stock in at least one two-high roll stand with an open pass, starting from any desired cross section, to form rolled stock which is tetragonal in cross section, guiding the rolled stock over a predetermined distance along one or more longitudinal edges and/or along those surfaces of the rolled stock which adjoin longitudinal edges, to a further roll stand, and subsequently rolling to form rolled stock which is circular in cross section in at least one closed pass, in which rolling forces act on and deform the rolling stock in a star shape from at least three directions.

2. Precision-rolling process according to claim 1, wherein the rolling stock is rolled in two two-high roll stands, which are arranged one behind the other, to form rolled stock which is tetragonal in cross section, and is guided between the two two-high roll stands.

3. Profile-rolling device for producing rolled stock which is circular in cross section wherein:

at least one two-high roll stand with an open, tetragonal roll pass, a rolled-stock guide which adjoins the two-high roll stand in a rolling direction and has guide devices which guide the rolled stock emerging from the two-high roll stand on one or more of longitudinal edges or on surfaces of the rolled stock which adjoin longitudinal edges of the rolled stock, and at least one further roll stand with a closed, circular pass with at least three rolls arranged in a star shape.

4. Profile-rolling device according to claim 3, wherein two two-high roll stands each with a tetragonal roll pass are provided with a guide arranged between them.

5. Profile-rolling device according to claim 3, wherein the rolls of the further roll stand are supported against one another by conical surfaces, the rolls being pressed against one another by a screw-down force which exceeds the rolling force by a preloading force.

6. Profile-rolling device according to claim 3, wherein the closed pass has a cross-sectional area which is 5 to 20% smaller than that of the open pass of the two-high roll stand.

7. Profile-rolling device according to claim 3, wherein the further roll stand has four rolls, of which only two opposite rolls can be driven by a motor, and in that each of the four rolls bears against a conical surface of a further roll in each case by a conical surface, each roll bearing against two adjoining rolls, and a closed flux of force and a frictional drive for the rolls which are not driven by the motor being established via the conical surfaces of the rolls.

8. Profile-rolling device according to claim 3, where the two-high roll stand and/or the further roll stand is/are in each case arranged on a stand-changing trolley which can slide along rails into a working position, in which it can be fixed, and can slide out of this position back into an at-rest position.

9. Profile-rolling device according to claim 3, wherein the shaping surfaces of the rolls which form the closed pass have a chamber on the circular edges which adjoin one another (FIG. 1*d*).

10. Profile-rolling device according to claim 3, wherein the guide devices are formed by shaping rollers.

11. Profile-rolling device according to claim 7, wherein the driven rolls of the further roll stand have a larger diameter in the shaping surfaces than the rolls which are not driven by means of their own drive.

12. Profile-rolling device according to claim 7, those rolls of the further roll stand which can be driven by the motor can be displaced towards the two further rolls in the direction of their shafts.

13. Profile-rolling device according to claim 7, wherein the further roll stand has two stand units which are preloaded towards one another by means of tie bars and threaded nuts.

14. Profile-rolling device according to claim 13, wherein the threaded nuts are designed as hydraulic nuts.

* * * * *